US011529549B2

(12) United States Patent
Henniger et al.

(10) Patent No.: US 11,529,549 B2
(45) Date of Patent: Dec. 20, 2022

(54) PULL UP SYSTEM AND BAR LOCKING FASTENER THEREFOR

(71) Applicant: Coulter Ventures, LLC., Columbus, OH (US)

(72) Inventors: William Henniger, Columbus, OH (US); Nash Dunahay, Columbus, OH (US)

(73) Assignee: Coulter Ventures, LLC., Columbus, OH (US)

( * ) Notice: Subject to any disclaimer, the term of this patent is extended or adjusted under 35 U.S.C. 154(b) by 0 days.

(21) Appl. No.: 17/209,488

(22) Filed: Mar. 23, 2021

(65) Prior Publication Data

US 2022/0008784 A1 Jan. 13, 2022

Related U.S. Application Data

(63) Continuation of application No. 16/103,015, filed on Aug. 14, 2018, now abandoned.

(60) Provisional application No. 62/544,954, filed on Aug. 14, 2017.

(51) Int. Cl.

| | |
|---|---|
| ***A63B 23/12*** | (2006.01) |
| ***A63B 21/068*** | (2006.01) |
| ***A63B 1/00*** | (2006.01) |

(52) U.S. Cl.

CPC ..... *A63B 23/1218* (2013.01); *A63B 1/00* (2013.01); *A63B 21/068* (2013.01); *A63B 2208/029* (2013.01)

(58) Field of Classification Search

CPC ..... A63B 1/00; A63B 21/068; A63B 21/169; A63B 23/1218; A47G 25/06–08; A47B 96/027; A47B 96/061

See application file for complete search history.

(56) References Cited

U.S. PATENT DOCUMENTS

| | | | | |
|---|---|---|---|---|
| 3,917,423 | A | 11/1975 | Ehlenbeck | |
| 5,156,580 | A * | 10/1992 | Holland | A63B 1/00 482/38 |
| 6,394,932 | B1 * | 5/2002 | Chu | A63B 1/00 482/37 |
| 7,175,548 | B2 | 2/2007 | McNulty | |
| 7,703,732 | B2 * | 4/2010 | Dantuono | A47B 96/061 211/90.03 |
| 9,289,065 | B1 * | 3/2016 | Lambertson | A47K 10/04 |
| 2016/0023035 | A1 | 1/2016 | Meyer | |
| 2017/0100624 | A1 | 4/2017 | Young | |

OTHER PUBLICATIONS

Uxcell 20 Pcs MS Car Bronze Tone Carbon Steel Thread Half Hexagonal Rivet Nut Nutserts, Jan. 10, 2017, www.amazon.com/uxcell-Bronze-Carbon-Hexagonal-N utserts/dp/B0 1 MS63 NZ7 /ref=sr 1_2?keywords=hexagonal+rivet&qid = 1576102344 &amp ;sr=8-2. (Year: 2017).

* cited by examiner

*Primary Examiner* — Jennifer Robertson
(74) *Attorney, Agent, or Firm* — Banner & Witcoff, Ltd.

(57) ABSTRACT

A pull up system including a bar member a support assembly. The bar member is coupled to the support assembly and the support assembly is attachable to an outside surface. A bar locking fastener is likewise disclosed, as is a support assembly for a pull up system.

29 Claims, 5 Drawing Sheets

PULL UP SYSTEM AND BAR LOCKING FASTENER THEREFOR

CROSS-REFERENCE TO RELATED APPLICATIONS

This application is a continuation of U.S. patent application Ser. No. 16/103,015, filed Aug. 14, 2018, which is a non-provisional of and claims priority from U.S. Patent Application Ser. No. 62/544,954, filed Aug. 14, 2017, entitled "Pull Up System and Bar Locking Fastener Therefor," the entire disclosures of which prior applications are hereby incorporated by reference in their entireties.

BACKGROUND OF THE DISCLOSURE

1. Field of the Disclosure

The disclosure relates in general to exercise equipment, and more particularly, to a pull up system as well as to a bar locking fastener utilized with the pull up system.

2. Background Art

The performance of body weight exercises has long been the mainstay of many athletes. One of these body weight exercises is the pull up (also sometimes known as a chin up). Such body weight exercises are known and equipment for such exercises has been known.

Typically, such equipment comprises a bar (generally of a substantially uniform round cross-sectional configuration). Such bars are coupled to support arms, support members, or other structures which essentially suspend the bar therebetween. In many instances, the bar is welded to the support structures. As such, the bar is essentially permanently coupled to the support structures.

In other configurations, the bar may be releasably coupled to the support structures. In some such configurations, the supports may include a bar with openings configured to slidably receive a bar member. Typically, the bar member is maintained in the desired position by a clamp bolt that can sandwich the bar member against the opening. Typically, such a clamp bolt relies upon an opening transverse to the bar opening, which opening has a threaded nut welded thereover. The bolt can be threaded through the fastener and the opening and into contact with the bar. One such configuration is shown in the P3 Pull-Up system offered by Rogue Fitness of Columbus, Ohio. Problematically, such a construction is typically time consuming and requires proper alignment of the nut and the opening.

Additionally, in many instances the support arms comprise relatively complex systems of components that are welded together. Again, such a system is time consuming and costly to manufacture due to the different components and the welding that is required to join the different components.

SUMMARY OF THE DISCLOSURE

The disclosure is directed to a pull up system comprising a bar member and a support assembly. The bar member is coupled to the support assembly. The support assembly is attachable to an outside surface.

In an aspect of the disclosure, the disclosure is directed to a pull up system comprising a bar member, and a support assembly. The bar member has a first end and a second end opposite the first end. The bar member has an outer surface.

The support assembly is attachable to an outside surface. The support assembly includes a first arm member and a second arm member which are spaced apart from each other. Each has a proximal end and a distal end opposite the proximal end with the distal end spaced apart from the outside surface. At least one of the first arm member and the second arm member includes a transverse opening and a bar locking fastener. The transverse opening is structurally configured to receive the bar member slidably therethrough with a locking opening positioned proximate thereto, and in communication therewith.

The bar locking fastener has a flange nut with an upper portion and a lower flange. The upper portion has a perimeter which shape matingly engages the locking opening so as to preclude substantial rotation therebetween when the upper portion is inserted into the locking opening. The lower flange is configured such that passage thereof through the locking opening is precluded when in the operable position between the locking opening and the transverse opening. A bolt is threadedly engaged with the flange nut, with a lower end surface extendable into the transverse opening. Upon positioning of the bar member through the transverse opening, the lower end surface of the bolt can be threadedly engaged with the flange nut to clamp the bar member to the arm member.

In some configurations, the bar member has a substantially circular cross-sectional configuration.

In some such configurations, the bar member is a substantially elongated cylindrical member.

In some configurations, the first arm member and the second arm member each include the transverse opening and the bar locking fastener.

In some configurations, the transverse opening comprises a polygonal configuration.

In some such configurations, the upper portion of the flange nut comprises a polygonal configuration.

In some such configurations, the polygonal configuration of each of the transverse opening and the upper portion of the flange nut each comprise a hexagonal configuration.

In some configurations, the lower flange comprises a substantially circular configuration.

In some configurations, the flange nut is separable from the transverse opening so as to selectively permit coupling and decoupling of the same.

In some configurations, the first arm member and the second arm member are substantially parallel to each other and spaced apart from each other a distance that corresponds to a distance that is less than a length of the bar member.

In another aspect of the disclosure, the disclosure is directed to a bar locking fastener for a pull up system that includes a flange nut and a bolt. The flange nut is insertable into a corresponding opening of an arm member of a support assembly, proximate a transverse opening. The bolt is threadable through the flange nut and extendable into the transverse opening.

In some configurations, the flange nut includes an upper portion and a lower flange. The upper portion has a shape that limits rotation within the transverse opening.

In some configurations, the flange nut comprises a polygonal configuration.

In some configurations, the polygonal configuration comprises a hexagonal configuration.

In some configurations, the lower flange has a circular configuration.

In another aspect of the disclosure, the disclosure is directed to a support assembly for a pull up system. The system comprises an arm member and a bar locking fastener.

The arm member has a proximal end and a distal end, a first side and a second side opposite the second side, and a top surface and a bottom surface opposite the top surface so as to define an elongated member with a substantially rectangular cross-sectional configuration. A transverse opening extends through the first side and the second side. The transverse opening is structurally configured to have a bar member extendable through the transverse opening; opening. The locking opening extending through one of the top surface and the bottom surface and in communication with the transverse opening. The locking opening having a shape.

The bar locking fastener having a flange nut and a bolt. The flange nut has an upper portion and a lower flange. The flange nut is insertable through the transverse opening so as to extend the upper portion through the locking opening, with the lower flange sized so as to preclude passage thereof through the locking opening, and with the shape of the locking opening limiting rotation of the flange nut therein. The bolt has a shaft threadable through the flange nut so as to be extendable into the transverse opening. The bolt has a lower end surface engageable with the bar member, upon insertion of the bar member through the transverse opening.

In some configurations, the transverse opening comprises a generally circular opening.

In some configurations, the transverse opening is positioned closer to the distal end than the proximal end of the arm member.

In some configurations, the shape of the locking opening and the upper portion of the flange nut each comprise a polygonal configuration.

In some configurations, the flange nut is separable from the arm member.

BRIEF DESCRIPTION OF THE DRAWINGS

The disclosure will now be described with reference to the drawings wherein.

DETAILED DESCRIPTION OF THE DISCLOSURE

Figure 1:
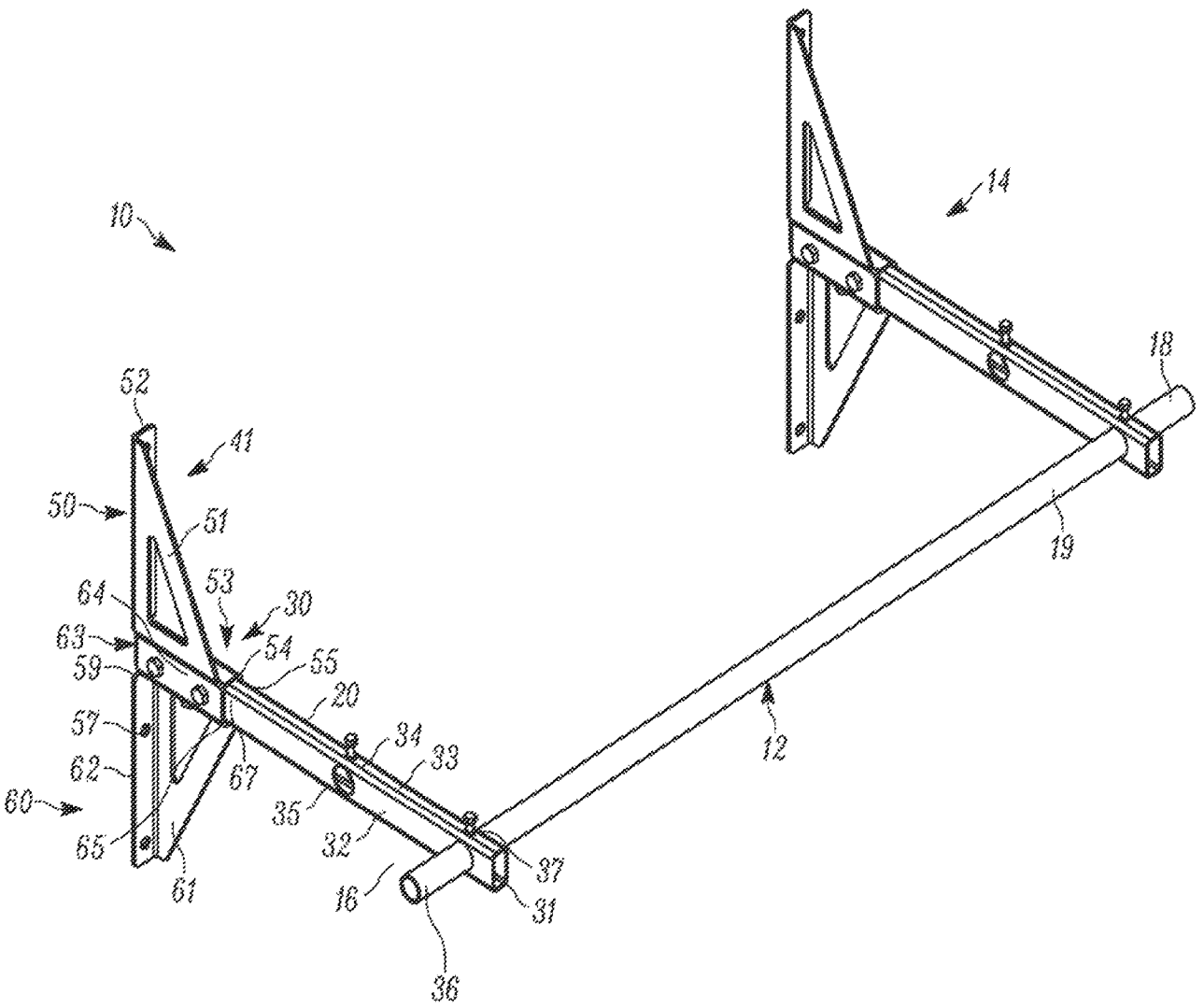
FIG. 1 of the drawings is a perspective view of a configuration of the pull up system of the present disclosure, showing, in particular, the bar locking fastener of the present disclosure.

While this disclosure is susceptible of embodiment in many different forms, there is shown in the drawings and described herein in detail a specific embodiment(s) with the understanding that the present disclosure is to be considered as an exemplification and is not intended to be limited to the embodiment(s) illustrated.

It will be understood that like or analogous elements and/or components, referred to herein, may be identified throughout the drawings by like reference characters. In addition, it will be understood that the drawings are merely schematic representations of the invention, and some of the components may have been distorted from actual scale for purposes of pictorial clarity.

Referring now to the drawings and in particular to FIG. 1, the pull up system is shown generally at 10. The pull up system is typically mounted to a wall or to a ceiling spaced apart from the ground so that a user can utilize the pull up system to perform exercises such as pull ups, chin-ups, muscle ups, hangs, among others. Indeed, the pull up system is not limited to any particular exercise nor is the same limited to attachment to any particular outside device. In some configurations, the pull up system, for example, may be configured to be free standing, and mounted to a stand of various types. In other configurations, the pull up system may be releasably mounted to an outside structure, such as a tree or the like.

In the configuration shown, the pull up system comprise bar member 12 and a plurality of support assemblies, such as support assembly 14. It is to be understood the pull up system 10 is manufactured with a substantially strong metallic material such that it allows for supporting an adult body within motion. Further, it is to be understood the pull up system 10 includes two support assemblies 14 be positioned parallel in reference to one another along a planar wall. Distance between the two support assemblies 14 is, in many instances, the length of the bar member 12. A number of different assemblies of the bar member 12 and support assembly 14 are contemplated. For example, a contemplated configuration designed outside of the scope of the figures is an extended bar member 12 that is secured through three support assemblies 14 that are all parallel and equal in reference to one another. Further, the bar member 12 in the contemplated assembly is perpendicular in reference to all previously described support assemblies and equal secured to each.

As illustrated in FIG. 1, bar member 12 comprises first end 16, second end 18, and outer surface 19. The length of the bar member 12 is defined by the distance between first end 16 and second end 18. In the configuration shown, the bar member 12 is substantially of a uniform circular cross-sectional construction and include an inner hollow structure or cavity such that the bar member is has a pipe-like configuration. It will be understood that the first end and the second end may be capped with a cap or other covering to preclude ingress into the inner hollow structure. In other configurations, the ends may remain open and access to the inner cavity is permitted. In other configurations, it is Contemplated that bar member 12 may define non-circular cross-sectional shapes, such as oval, square, polygonal, arbitrary or other shapes. It will further be understood that the cross-sectional configuration may change along the length thereof between the first and second ends thereof.

Additionally, while a generally hollow bar 12 is shown, it will be understood that the bar 12 may be solid, or may include reinforcing ribs or other structures that extend within the hollow cavity (wherein the bar can be formed from an extrusion or the like, for example). It will be understood that the bar is formed, preferably from a metal member, and may have a finish or a coating thereon. For example, the metal member may be anodized, painted, powder coated, dipped, or otherwise finished. Additionally, surface finishes such as knurling, for example, are also contemplated.

Figure 2:
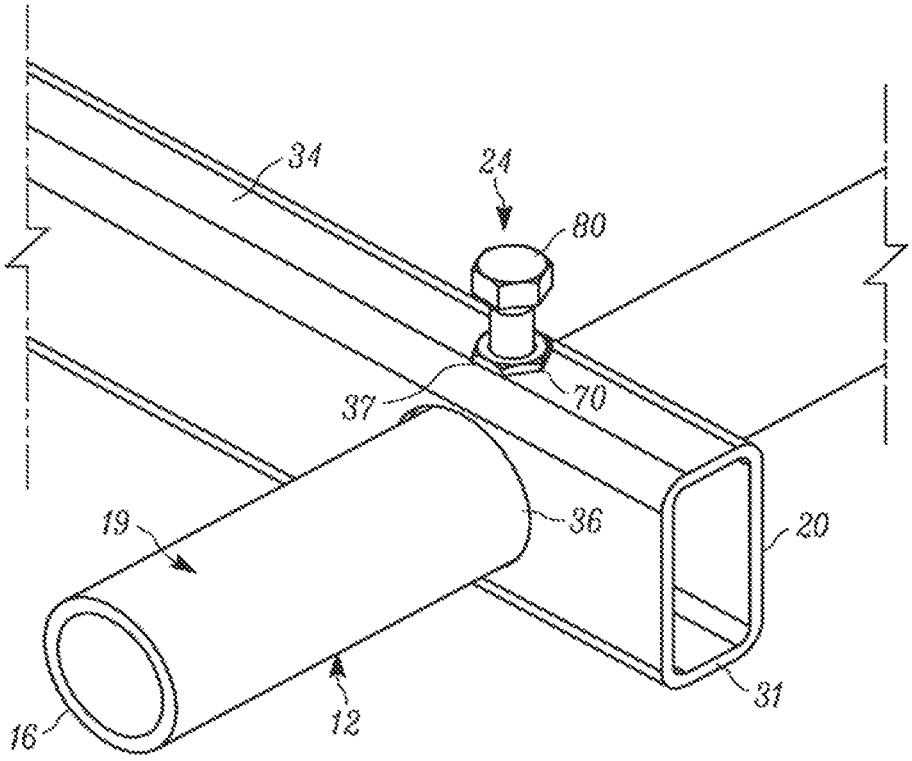
FIG. 2 of the drawings is a partial perspective view of the pull up system of the present disclosure, showing, in particular, the bar locking fastener of the present disclosure.
Figure 3:
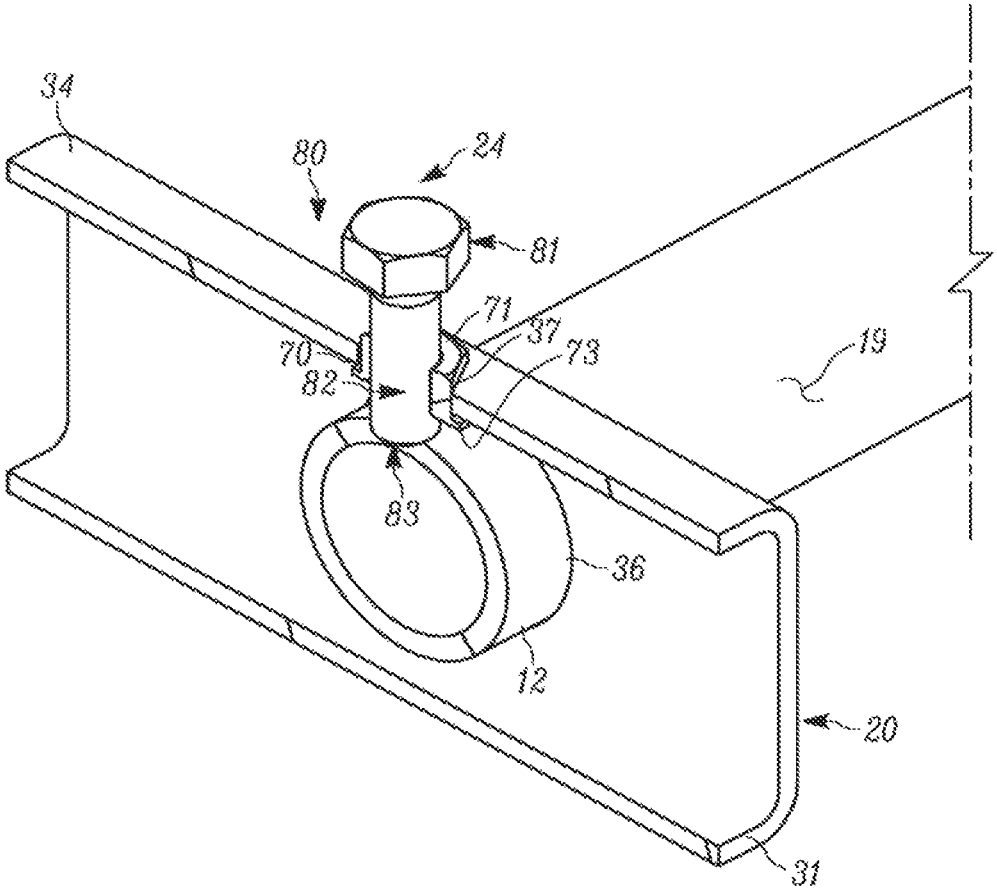
FIG. 3 of the drawings is a partial cross-sectional view of the bar locking fastener of the present disclosure, in the clamping configuration.

As illustrated in FIGS. 1, 2, and 3, support assembly 14 comprises an arm member 20, wall coupling member 22, and bar locking fastener 24. The arm member 20 includes proximal end 30 and distal end 31 which defines the length of the arm member 20. In the configuration shown, the arm member 20 has a generally rectangular cross-sectional configuration (which is again hollow, defining a cavity), and includes first side 32, second side 33, top surface 34 and bottom surface 35 on the vertical plane. It will be understood that a number of different configurations are contemplated for the arm member 20 for example, in reference to location of coupling, size differences, and shapes of both members. Additionally, it will be understood that while the arm members are shown to be identical, variations between arm members is contemplated.

The arm member 20 further comprises at least one transverse opening 36 aligned axially through the first side 32 and second side 33. Transverse openings 36 are generally of equal or greater dimension relative to the bar member 12 so that the bar member can be slidably extended through the openings. A plurality of transverse openings 36 may be present along the arm member 20. Further, transverse openings are separated by a contemplated distance along the length of the arm member, between the proximal end 30 to the distal end 31. In the configuration shown, two openings are positioned in a spaced apart orientation with the first of the openings being positioned proximate the distal end, and the second being spaced therefrom toward the proximal end. In the configuration shown, both openings remain closer to the distal end than the proximal end. Additionally, both openings are substantially identical in configuration, although the same is not required.

Figure 4:
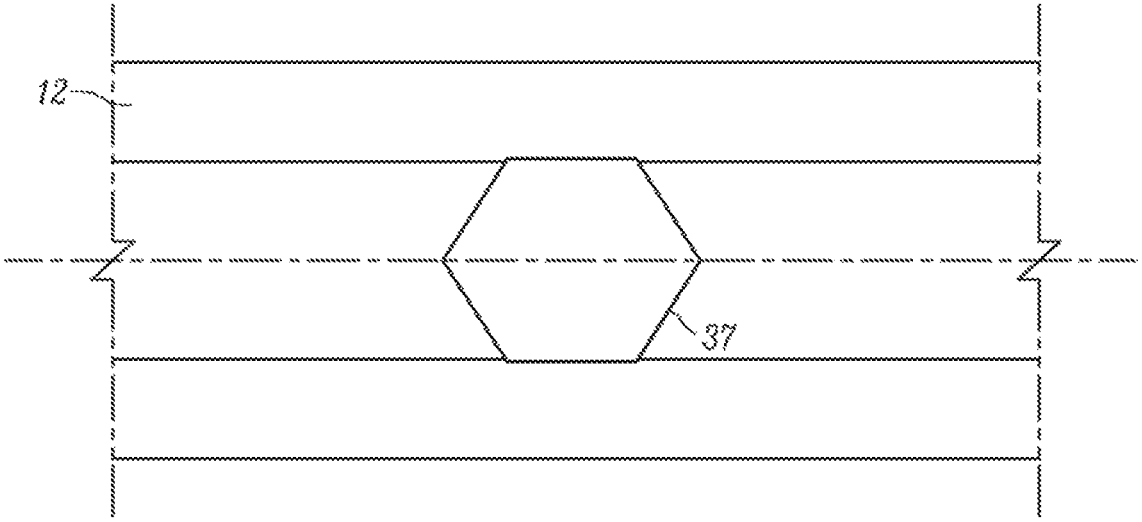
FIG. 4 of the drawings is a partial top plan view of the arm member, showing, in particular, the locking opening.

With additional reference to FIG. 4, in addition to FIGS. 1 through 3, located along with the transverse openings 36 are corresponding locking openings 37. In particular, the locking openings extend through the top surface 34 of the arm member 20 just above the openings. More specifically, the locking openings 37 are located along just above of the center of the transverse openings 36. That is, for each transverse opening 36 positioned along the arm member 20, a locking opening 37 is present just above through the top surface. Locking openings 37 are shaped in a hexagonal manner with all sides substantially equal in size in relation to one another, in the configuration shown, to substantially match a hexagonal fastener. It is contemplated that the opening may have a shape different than the hexagonal shape, wherein the shape precludes rotation of a structure positioned therein, which has the same shape. As such, an opening other than circular is contemplated. That is, the opening is preferably keyed in some manner such that positive engagement (without relative rotation) can be achieved (as will be explained below). Additionally, while the locking opening is shown to be in the top surface, the opening can likewise be present in the bottom surface, or in both surfaces. In some configurations, additional surfaces (which are outside of the transverse opening but close thereto) may likewise define the locking openings.

The wall coupling member 22, as is shown in FIG. 1 comprises first gusset bracket 50 and second gusset bracket 60. The two gusset brackets are substantially identical to each other. As such, the first gusset bracket will be described in detail with the understanding that the second gusset bracket is substantially equivalent thereto (and their coupling will be described below, thereafter). First gusset bracket 50 comprises a base web 51, a wall coupling portion 52 and an arm coupling portion 53. The base web 51 forms the body of the structure, and in the configuration shown, comprises a generally planar right triangle having two legs that are associated with each other at right angles. The wall coupling 52 comprises a flange, that, in the configuration shown, extends from one of the legs generally perpendicular to the base web. In the configuration shown, the wall coupling extends generally along the entire length of the leg and is likewise substantially planar. A plurality of openings are defined in the wall coupling, and wall fasteners, such as wall fasteners 57 are extendable therethrough.

The arm coupling portion 53 further comprises first wall 54 and second wall 55. The first wall 54 of the arm coupling portion 53 extends generally perpendicular to the base wall and on the same side thereof as the wall coupling 52. The second wall extends from the end of the first wall 54, opposite the base web 51, and extends in a direction away from the base web. In the configuration shown, the first wall and the second wall are substantially perpendicular, such that the second wall is parallel to the base web 51. In other words, the first wall 54 is separated from the base web by a distance substantially equal to the width of the second wall 55 and is perpendicular thereto.

As set forth above, the first gusset bracket 50 and second gusset bracket 60 are substantially identical to one another. As such, the second gusset bracket 60 comprises a base web 61, a wall coupling portion 62 and an arm coupling portion 63. The base web 61 forms the body of the structure, and in the configuration shown, comprises a generally planar right triangle having two legs that are associated with each other at right angles. The wall coupling 62 comprises a flange, that, in the configuration shown, extends from one of the legs generally perpendicular to the base web. In the configuration shown, the wall coupling extends generally along the entire length of the leg and is likewise substantially planar. A plurality of openings is defined in the wall coupling, and wall fasteners, such as wall fasteners 57 are extendable therethrough.

The arm coupling portion 63 further comprises first wall 64 and second wall 65. The first wall 64 of the arm coupling portion 63 extends generally perpendicular to the base wall and on the same side thereof as the wall coupling 62. The second wall extends from the end of the first wall 64, opposite the base web 61, and extends in a direction away from the base web. In the configuration shown, the first wall and the second wall are substantially perpendicular, such that the second wall is parallel to the base web 61. In other words, the first wall 64 is separated from the base web by a distance substantially equal to the width of the second wall 65 and is perpendicular thereto.

Figure 5:
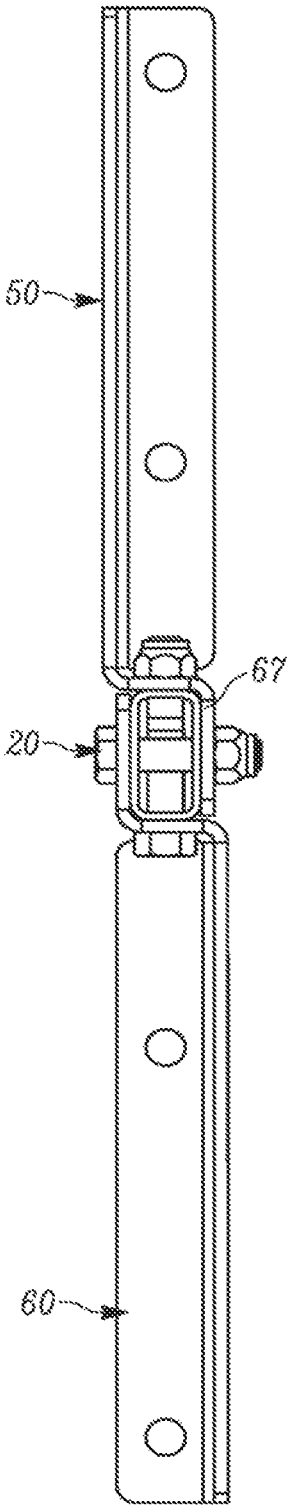
FIG. 5 of the drawings is a front elevational view of the arm member, showing, in particular, the arm slot formed thereby.

To couple the structures together, the first gusset bracket 50 is, relative to the second gusset bracket 60, rotated 180 degrees about an axis that is centrally located relative to the first and second walls of the arm couplings and substantially parallel thereto. When relatively rotated and positioned together, the arm coupling portions 53, and 63 of the first and second gusset brackets 50, 60 form a pocket, or arm slot 67 (also in FIG. 5) which has a cross-section substantially corresponding to the arm member 20 proximate the proximal end, such that, and as will be explained below, the arm member can be slidably inserted into the arm slot.

The wall coupling member 22 further includes wall fasteners 57 and arm fasteners 59. Wall fasteners 57 are tapered and aligned planer to the first wall coupling portion 52 and second wall coupling portion 62. A plurality of wall fasteners 57 are used for both the first gusset bracket 50 and second gusset bracket 60 in such a number than the wall coupling member 22 is substantially mated to the external surface. Wall fasteners 57 are vertically aligned substantially in relation to one another between the first gusset bracket 50 and second gusset bracket 60 of the wall coupling member 22, in the configuration shown. The number of wall fasteners 57 are contemplated in different numbers per configurations of the wall coupling member 22, first gusset bracket 50, and second gusset bracket 60 sizes.

Arm fasteners 59 are axially aligned through the second wall 55 and second wall 65 of the first gusset bracket 50 and second gusset bracket 60 of wall coupling member 22, respectively. Arm fasteners run through both the first gusset bracket 50 and second gusset bracket to secure and mate the arm member 20 (through appropriate openings therein which are not shown) to the arm slot 67 created by the conjoined gusset members. Once secure, the first side 32 of the arm member 20 will be mated and coupled to the interior of first wall 64 of second gusset bracket 60 through the axial alignment of the arm fasteners 59. Further, the second side 33 of the arm member 20 will be mated to the interior of the first wall 54 of the first gusset bracket 50 through the axial alignment of the arm fasteners 59. As contemplated in alternate configurations, the fasteners may be of different sizes, lengths, and possess alternate securing mechanisms including, but not limited to, tapered screws, nails, or bolting systems. The base web 51 of the wall coupling member 22 for both gusset brackets is the primary load member of the design. Additional fasteners may be configured to extend through the first walls 54, 64 of the gusset brackets as well, and, correspondingly through corresponding openings of the arm member.

As is shown in FIGS. 2 and 3, the bar locking fastener 24 is a securing device positioned within the locking opening 36 of the arm member 20. The bar locking fastener comprises a flange nut 70 and bolt 80. The flange nut 70 has an upper portion 71 and lower flange 73. It is to be understood the upper portion 71 is hexagonal in shape and has size substantially corresponding to the locking opening 37 such that when inserted thereinto, the flange not is precluded from a complete rotation due to the correspondence of shape (i.e., it is, at least to some extent, keyed). The upper portion 71 and locking opening 37 may have alternative shapes in contemplative configurations, as is discussed above, with the understanding that relative rotation is limited.

Further, the lower flange 72 is of radially size substantially larger than the locking opening 37, in such a way that movement through the locking opening 37 for the lower portion 72 is not feasible when the upper portion is extended into an operable position. The combination of features involving the flange nut 70 results in a structure that can be axially slid into the locking opening 37 from the inside (i.e., by being inserted into the transverse opening prior to slidable insertion of the bar member), without being able to slide through due to the lower flange being larger than the locking opening. Further, due to the hexagonal configuration about the upper portion 71 of the flange nut 70, rotation of the flange nut 70 while in an operable position within the locking opening is restricted due to the mated sides of the hexagonal surface and the general corresponding structures.

The bolt 80 of bar locking fastener 24, as shown in FIG. 3, comprises a head 81 and shaft 82, which further includes lower end surface 83. The head 81 of the bolt 80 is mated to the shaft 82 which terminates at lower end surface 83. Shaft 82 is threaded and matingly engages the threads of the flange nut 70. The length of shaft 82 is dependent upon a the configuration of a number of different structures, including but not limited to, the length of flange nut 70, the size of the transverse opening, the configuration of the bar member, and/or the thickness of the arm member and is contemplated to be of varying lengths depending upon use, material, and configuration of the pull up system 10.

To assemble the bar locking fastener 24 into an operable configuration, first the flange nut 70 is inserted through the locking opening 37. Placement is done from the interior of arm member 20, such as, for example, through the transverse opening. The upper portion 71 of the flange nut fits into the locking opening 37 until the lower flange 73 is mated to the interior of the top surface 34 of bar member 20. Following this, the shaft 82 of bolt 80 is placed axially in alignment with the interior of the flange nut 70 and the two are threaded together It is desirable that the head of the bolt is larger than the opening so that, absent a bar member, the bolt does not fall through the locking opening. Additionally, if the locking opening and the flange nut are such that an interference fit can be created therebetween when the flange nut is inserted into the locking opening.

Advantageously, with the present configuration, the assembly of the subsystems to the pull up system 10 does not require welding or other mating, and, instead the pull system 10 are assembled using prefabricated fasteners of contemplated sizes and lengths.

To assemble the pull up system of the present disclosure, the user is first provided with the various components. For example, in the configuration shown, the pull-up system 10 includes one bar member 12, two arm members 20, and four gusset brackets. The quantity of bar locking fasteners 24, wall fasteners 57, and arm fasteners 59 are dependent upon a number of different factors. It will be understood that while the system is shown with only two arm members, it is contemplated that the system my include more than two arm members and that the bar member may be of sufficient length to require multiple arm members. Alternatively, multiple arm members may be utilized with a separate bar member being positioned therebetween, such that arm members between the end arm members have a separate bar member extending from either side thereof.

The mounting of the pull up system will be described with the mounting thereof onto a substantially vertical and planar surface. Of course, the structure, a identified above, can be mounted to any number of different outside devices. Mounting of the pull up system 10 is initiated by the formation of the support assembly. Specifically, the first gusset bracket 50 and the second gusset bracket 60 are assembled by putting the second gusset bracket is positioned in a manner opposite in relation to the first gusset bracket 50. That is, the second gusset bracket 60 is rotated 180 degrees in relation to the first gusset bracket 50.

The positioning of the two forms the arm slot 67. And, the arm member 20 is inserted into the arm slot 67 by insertion via proximal end 30 thereinto. The arm slot, as discussed above is substantially equal in height and width to the height and width of the arm member 20 to allow insertion, while maintaining a, preferably snug fit. In some configurations, the arm member may form the body with the arm coupling portion being positionally defined thereby. The arm member 20 is placed with proximal end 30 within the cavity until such point arm fasteners 59 are aligned along the first wall 54, arm member 20, and first wall 64. The arm fasteners 59 are secured through tapered insertion, using an external tool to supply necessary force to thread the axially aligned arm fasteners 59 through the first wall 54, first wall 64 and arm member 20.

The first of the support assemblies are now formed. As the configuration shown has a pair of substantially identical support assemblies, a second support assembly is formed by again coupling an arm member with a wall coupling member having a first and second gusset bracket.

In some configurations, the two support assemblies are coupled to the vertical surface in a spaced apart orientation, and in an orientation wherein the two arm members are mounted so as correspond, and so that the transverse openings thereof align with each other. In other configurations, the bar member is first assembled, and then the entire structure may be mounted to an outside structure. In either manner, it becomes necessary to mount the support assembly to the vertical surface. In either instance, the wall fasteners 57 are directed into the vertical surface. In some configurations, the vertical surface may comprise studs or wood/metal based structures wherein appropriate fasteners may comprise lag bolts or the like. In other instances bolts may be utilized, wherein the surface comprises a rack or other framework. In still other configurations, masonry screws may be utilized. It will be understood that the particular fasteners that are utilized are not to be deemed limiting, and these are to be considered exemplary.

To secure the bar member 12 to the arm member 20, with reference to FIGS. 2 and 3, the bar locking fastener is first coupled to the respective arm member. In particular, bar locking member 24 is prepared by placing flange nut 70 within the locking opening 37 in such a way that the upper portion 71 of the flange nut is sufficiently mated to the locking opening while the lower flange 73 of the flange nut 70 remains within the interior of the arm member 20. Generally, the fit between the opening and the upper portion of the flange nut comprises an interference fit. Typically, although not required, the lower flange is mated to the interior of the top surface 34 of the bar member. It will be understood that the flange nut is directed between the top surface and the transverse opening so as to allow passage of the arm member through the transverse opening. The bolt is placed with lower end surface 83 of shaft 82 facing towards the bottom surface 35 of arm member 20 and threaded onto the nut to a desired depth (typically, this would be such that the two do not separate, but that the bolt does not obstruct the passage of the arm member therethrough). In the configuration shown, each of the arm members have two transverse openings, and, as such, a total of four bar locking fasteners may be required for assembly.

Once the desired bar locking fasteners are formed, the bar member 12 of the pull up system 10 is directed through a transverse opening 36 of each one of the arm members 20 to which it is to be coupled (which is two in the present configuration). As set forth above, when assembled and coupled to a wall (or set up for attachment of the bar member), the transverse opening 36 of the first arm member 20 and the transverse opening 36 of the second arm member 20 of the support assembly 14 are placed in substantial alignment. It will be understood that the separate support assemblies are positioned at a desired distance apart from each other with the understanding that the bar member is of sufficient length to span therebetween (and typically to have a portion extend beyond each of the support assemblies). In many instances, the bar member is sized appropriately for systems that will be mounted at some multiple of 16" on center, for example, as this will correspond to the gap between studs or vertical supports in typical construction in North America.

Upon placement of the bar member 12 into and through the desired transverse openings, bolt 80 of the bar locking fastener 24 is tightened. Continued tightening will result in the lower end surface 83 of the bolt 80 resting on the outer surface 19 of the bar member 12 in such a way that it supplies a downward force that forces a coupling between the bar member and arm member 20 through the transverse opening, essentially sandwiching the bar member between the bolt and the transverse opening perimeter. Because the locking opening 37 which holds the bar locking faster 24 is of substantially equal shape as the flange nut 70 upper portion 71, the flange nut will not rotate any appreciable amount (i.e., an amount that destroys the functionality of the combination) while the bolt 80 is being placed and the flange precludes the passage of the nut entirely through the locking opening.

Further bar members or arms can be provided and coupled as desired to the appropriate transverse opening. From time to time, it may be desirable to remove the bar member, or to move the bar member to be between other transverse openings. In such an instance, the user can loosen the appropriate bolts of the desired bar locking fasteners to release the clamping hold on the respective bar member. Once each of the bolts that retain the particular bar member are loosened, the user can slidably remove the bar member from interaction with the respective transverse openings, and remove the bar member.

It is contemplated that while the particular support assembly is shown, the bar locking fastener can be utilized with other systems and with other types of pull up systems that include different manners of coupling to outside structures. For example, the particular type of fastener can be utilized, without limitation, in the pull up support assemblies that are of the type that are sold under the trade names P-3 Pull-Up System, P-4 Pull-Up System, P-6V Garage Pull-Up System, P-5V Garage Pull-Up System and/or the Infinity Flying Pull-Up Bar, each of which are available from Rogue Fitness of Columbus, Ohio. In such systems, the support assembly includes a wall coupling members and arm members that are welded or otherwise joined together (with support members buttressing the coupling in some configurations), Some of such systems can be mounted from walls, ceilings or other structures that may be neither substantially vertical, substantially horizontal but substantially oblique to both the vertical and the horizontal.

The foregoing description merely explains and illustrates the disclosure and the disclosure is not limited thereto except insofar as the appended claims are so limited, as those skilled in the art who have the disclosure before them will be able to make modifications without departing from the scope of the disclosure.

What is claimed is:

1. A pull up system comprising:

a bar member having a first end and a second end opposite the first end, the bar member having an outer surface; and a support assembly attachable to an outside surface, the support assembly including:

a first arm member and a second arm member each comprising a tube member having a peripheral wall defining an elongated cavity, the first and second arm members spaced apart from each other, and each having a proximal end and a distal end opposite the proximal end with the distal end spaced apart from the outside surface and having a length defined between the proximal and distal ends, wherein the first arm member comprises:

a first transverse opening and a second transverse opening extending through the wall and into the cavity of the first arm member, wherein the first transverse opening is spaced from the second transverse opening along the length of the first arm member, each of the first and second transverse openings structurally configured to receive the bar member slidably therethrough;

a first locking opening and a second locking opening extending through the wall and into the cavity of the first arm member, the first locking opening being aligned with and proximate to the first transverse opening, and the second locking opening being aligned with and proximate to the second transverse opening, such that the first locking opening is spaced from the second locking opening along the length of the first arm member;

a first bar locking fastener and a second bar locking fastener each comprising a flange nut with an upper portion and a lower flange, the upper portion of the first bar locking fastener being received in the first locking opening and having a first perimeter which shape matingly engages the first locking opening so as to preclude substantial rotation therebetween, with the lower flange of the first bar locking fastener positioned within the cavity of the first arm member and engaging an inner surface of the wall of the first arm member adjacent to the first locking opening, such that passage of the lower flange through the first locking opening is precluded, and the upper portion of the second bar locking fastener being received in the second locking opening and having a second perimeter which shape matingly engages the second locking opening so as to preclude substantial rotation therebetween, with the lower flange of the second bar locking fastener positioned within the cavity of the first arm member and engaging the inner surface of the wall of the first arm member adjacent to the second locking opening, such that passage of the lower flange through the second locking opening is precluded, and wherein the second arm member comprises:

a third transverse opening and a fourth transverse opening extending through the wall and into the cavity of the second arm member, wherein the third transverse opening is spaced from the fourth transverse opening along the length of the second arm member, each of the third and fourth transverse openings structurally configured to receive the bar member slidably therethrough;

a third locking opening and a fourth locking opening extending through the wall and into the cavity of the second arm member, the third locking opening being aligned with and proximate to the third transverse opening, and the fourth locking opening being aligned with and proximate to the fourth transverse opening, such that the third locking opening is spaced from the fourth locking opening along the length of the second arm member;

a third bar locking fastener and a fourth bar locking fastener each comprising a flange nut with an upper portion and a lower flange, the upper portion of the third bar locking fastener being received in the third locking opening and having a third perimeter which shape matingly engages the third locking opening so as to preclude substantial rotation therebetween, with the lower flange of the third bar locking fastener positioned within the cavity of the second arm member and engaging an inner surface of the wall of the second arm member adjacent to the third locking opening, such that passage of the lower flange through the third locking opening is precluded, and the upper portion of the fourth bar locking fastener being received in the fourth locking opening and having a fourth perimeter which shape matingly engages the fourth locking opening so as to preclude substantial rotation therebetween, with the lower flange of the fourth bar locking fastener positioned within the cavity of the second arm member and engaging the inner surface of the wall of the second arm member adjacent to the fourth locking opening, such that passage of the lower flange through the fourth locking opening is precluded; and a plurality of bolts each being threadedly engageable with the flange nuts and each configured to be axially advanced through the respective flange nut to advance a lower end surface thereof into the cavity of the first arm member or the second arm member, wherein the bar member is configured to be positioned in at least a first position, where the bar member is received in the first transverse opening of the first arm member and the third transverse opening of the second arm member and extends into the cavities of the first and second arm members, and where two of the plurality of bolts are engaged with the flange nuts of the first bar locking fastener and the third bar locking fastener and engage the bar member within the cavities of the first and second arm members to clamp the bar member within the first transverse opening and the third transverse opening, and a second position spaced from the first position along the lengths of the first and second arm members, where the bar member is received in the second transverse opening of the first arm member and the fourth transverse opening of the second arm member and extends into the cavities of the first and second arm members, and where two of the plurality of bolts are engaged with the flange nuts of the second bar locking fastener and the fourth bar locking fastener and engage the bar member within the cavities of the first and second arm members to clamp the bar member within the second transverse opening and the fourth transverse opening.

2. The pull up system of claim 1 wherein the bar member has a substantially circular cross-sectional configuration.

3. The pull up system of claim 2 wherein the bar member is a substantially elongated cylindrical member.

4. The pull up system of claim 1 wherein the first arm member and the second arm member each include the first and second transverse openings and the first and second bar locking fasteners.

5. The pull up system of claim 4 wherein each of the first and second locking openings comprises a polygonal configuration.

6. The pull up system of claim 5 wherein the upper portion of each flange nut comprises a polygonal configuration.

7. The pull up system of claim 6 wherein the polygonal configuration of the locking openings and the upper portion of the flange nuts each comprise a hexagonal configuration.

8. The pull up system of claim 6 wherein each lower flange comprises a substantially circular configuration.

9. The pull up system of claim 1 wherein the flange nut is separable from the respective first, second, third or fourth locking opening so as to selectively permit coupling and decoupling of the same.

10. The pull up system of claim 1 wherein the first arm member and the second arm member are substantially parallel to each other and spaced apart from each other a distance that corresponds to a distance that is less than a length of the bar member.

11. The pull up system of claim 1, further comprising a pair of support brackets, each support bracket including an angled arm portion supporting one of the first arm member and the second arm member.

12. The pull up system of claim 11, wherein each support bracket comprises a first gusset bracket and a second gusset bracket, each gusset bracket including a base web, a surface coupling portion connected to the base web, and an arm coupling portion connected to the base web, the arm coupling portions of the first and second gusset brackets cooperating to receive the proximal end of the one of the first arm member and the second arm member.

13. The pull up system of claim 11, further comprising a plurality of fasteners, the fasteners extending through apertures in the arm coupling portions and respective apertures in a respective arm member.

14. A bar locking fastener for a pull up system comprising:

a support assembly attachable to an outside surface and having an arm comprising a tube member having a peripheral wall defining an elongated cavity, a first transverse opening and a second transverse opening extending through the wall and into the cavity of the arm, wherein the first transverse opening is spaced from the second transverse opening along a length of the arm, each of the first and second transverse openings structurally configured to receive a bar member slidably therethrough;

a first locking opening and a second locking opening extending through the wall and into the cavity of the arm, the first locking opening being aligned with and proximate to the first transverse opening, and the second locking opening being aligned with and proximate to the second transverse opening, such that the first locking opening is spaced from the second locking opening along the length of the arm;

a first flange nut matingly engaging the first locking opening and including an upper portion and a lower flange, the upper portion of the first flange nut being received in the first locking opening and having a first perimeter which shape matingly engages the first locking opening so as to preclude substantial rotation therebetween, with the lower flange of the first flange nut positioned within the cavity of the arm and engaging an inner surface of the wall of the arm adjacent to the first locking opening, such that passage of the lower flange through the first locking opening is precluded;

a second flange nut matingly engaging the second locking opening and including an upper portion and a lower flange, the upper portion of the second flange nut being received in the second locking opening and having a second perimeter which shape matingly engages the second locking opening so as to preclude substantial rotation therebetween, with the lower flange of the second flange nut positioned within the cavity of the arm and engaging an inner surface of the wall of the arm adjacent to the second locking opening, such that passage of the lower flange through the second locking opening is precluded; and a bolt threadable through each of the first and second flange nuts and extendable through each of the first and second locking openings into the first and second transverse openings to engage the bar member.

15. The bar locking fastener of claim 14 wherein each flange nut includes an upper portion and a lower flange, the upper portion having a shape that limits rotation within the respective first or second transverse opening proximate the first or second locking opening engaging the respective flange nut.

16. The bar locking fastener of claim 15 wherein each flange nut comprises a polygonal configuration.

17. The bar locking fastener of claim 16 wherein the polygonal configuration comprises a hexagonal configuration.

18. The bar locking fastener of claim 17 wherein each lower flange has a circular configuration.

19. The pull up system of claim 11, further comprising a support bracket including an angled arm portion supporting the arm.

20. The pull up system of claim 19, wherein the support bracket comprises a first gusset bracket and a second gusset bracket, each gusset bracket including a base web, a surface coupling portion connected to the base web, and an arm coupling portion connected to the base web, the arm coupling portions of the first and second gusset brackets cooperating to receive a proximal end of the arm.

21. The pull up system of claim 20, further comprising a pair of fasteners, each fastener extending through apertures in the arm coupling portions and an aperture in the arm.

22. A support assembly for a pull up system comprising:

an arm member configured to be secured to an outside surface and to extend substantially perpendicular to the outside surface, and having:

a proximal end and a distal end, a first side and a second side opposite the second side, and a top surface and a bottom surface opposite the top surface so as to define an elongated tube member with a substantially rectangular cross-sectional configuration and defining an elongated cavity;

a first transverse opening and a second transverse opening extending through the first side and the second side and into the cavity of the arm member, the first and second transverse openings structurally configured to have a bar member extendable therethrough;

a first locking opening and a second locking opening extending through one of the top surface and the bottom surface, the first locking opening in communication with the first transverse opening, and the second locking opening in communication with the second transverse opening, each of the first locking opening and the second locking opening having a shape; and a first bar locking fastener having:

a flange nut, the flange nut having an upper portion and a lower flange, with the flange nut insertable through the first transverse opening so as to extend the upper portion through the first locking opening, with the lower flange sized so as to preclude passage thereof through the first locking opening, and with the shape of the first locking opening limiting rotation of the flange nut therein; and a second bar locking fastener having:

a flange nut, the flange nut having an upper portion and a lower flange, with the flange nut insertable through the second transverse opening so as to extend the upper portion through the second locking opening, with the lower flange sized so as to preclude passage thereof through the second locking opening, and with the shape of the second locking opening limiting rotation of the flange nut therein; and a bolt having a shaft threadable through the flange nuts of the first and second bar locking fasteners so as to be extendable into the first and second transverse openings, with the bolt having a lower end surface engageable with the bar member, upon insertion of the bar member through the first or second transverse opening.

23. The support assembly of claim 22 wherein the transverse opening comprises a generally circular opening.

24. The support assembly of claim 22, wherein the transverse opening is positioned closer to the distal end than the proximal end of the arm member, wherein the arm member further comprises:

a second transverse opening extending through the first side and the second side of the arm member, the transverse opening and the second transverse opening being spaced at different distances between the proximal and distal ends of the arm member, the second transverse opening being structurally configured to have the bar member extendable therethrough;

a second locking opening extending through one of the top surface and the bottom surface and in communication with the second transverse opening, the second locking opening having a shape;

and wherein the support assembly further comprises:

a second bar locking fastener having:

a second flange nut, the second flange nut having an upper portion and a lower flange, with the second flange nut insertable through the second transverse opening so as to extend the upper portion through the second locking opening, with the lower flange sized so as to preclude passage thereof through the second locking opening, and with the shape of the second locking opening limiting rotation of the second flange nut therein; and a second bolt having a shaft threadable through the second flange nut so as to be extendable into the second transverse opening, with the second bolt having a lower end surface engageable with the bar member, upon insertion of the bar member through the second transverse opening.

25. The support assembly of claim 22 wherein the shapes of the first and second locking openings and the upper portion of the flange nut each comprise a polygonal configuration.

26. The support assembly of claim 22 wherein the flange nut is separable from the arm member.

27. The support assembly of claim 22, further comprising a support bracket supporting the arm, wherein the support bracket comprises a first gusset bracket and a second gusset bracket, each gusset bracket including a base web, a surface coupling portion connected to the base web, and an arm coupling portion connected to the base web, the arm coupling portions of the first and second gusset brackets cooperating to receive the proximal end of the arm member.

28. The support assembly of claim 27, wherein the base web comprises a generally planar right triangle having two legs, the surface coupling portion comprises a flange extending from one of the legs in a direction perpendicular to the base web, and the arm coupling portion comprises a first wall extending away from the base web in a direction perpendicular to the base web and a second wall extending from an end of the first wall in a direction parallel to the base web.

29. The support assembly of claim 22 further comprising a pair of fasteners, each fastener extending through apertures in the arm coupling portions and an aperture in the arm member.

* * * * *